US006011328A

United States Patent [19]

Smith

[11] Patent Number: 6,011,328

[45] Date of Patent: Jan. 4, 2000

[54] ELECTRIC POWER LOCKOUT APPARATUS

[75] Inventor: Terry L. Smith, 3424 S. Kenilworth Ave., Berwyn, Ill. 60402

[73] Assignee: Terry L. Smith, Cicero, Ill.

[21] Appl. No.: 09/057,300

[22] Filed: Apr. 8, 1998

[51] Int. Cl.[7] ..... H01H 73/02

[52] U.S. Cl. ..... 307/139; 307/119; 307/125; 307/141.8; 307/326

[58] Field of Search ..... 307/112, 113, 307/116, 125, 139, 141, 141.4, 141.8, 328, 326

[56] References Cited

U.S. PATENT DOCUMENTS

| | | | |
|---|---|---|---|
| 4,588,901 | 5/1986 | Maclay et al. | 307/141 |
| 4,870,531 | 9/1989 | Danek | 361/93 |
| 4,890,006 | 12/1989 | Huang | 307/112 |
| 5,125,492 | 6/1992 | Treleaven et al. | 194/241 |
| 5,283,475 | 2/1994 | Berger | 307/141.4 |
| 5,432,387 | 7/1995 | Kogure et al. | 307/328 |
| 5,434,368 | 7/1995 | Hoffman | 200/43.22 |
| 5,486,824 | 1/1996 | Kinerk et al. | 341/26 |
| 5,488,338 | 1/1996 | Seymour et al. | 335/202 |
| 5,579,221 | 11/1996 | Mun | 364/188 |
| 5,592,032 | 1/1997 | Keizer et al. | 307/116 |
| 5,596,263 | 1/1997 | Zavis et al. | 323/255 |
| 5,635,895 | 6/1997 | Murr | 340/310.01 |

OTHER PUBLICATIONS

Wolfe Guard™ AC–7.

Wolfe Guard™ AC–8.

Wolfe Guard™ Electronic Access and Braking System.

Wolfe Machinery Co. WMC Home Page.

*Primary Examiner*—Albert W. Paladini

*Attorney, Agent, or Firm*—Welsh & Katz, Ltd.; Thomas W. Tolpin; Scott M. Gettleson

[57] ABSTRACT

An electric power lockout apparatus is provided which includes an input terminal for electrically coupling the apparatus to an electric power source and an output terminal for electrically coupling the apparatus to a device requiring electric power. The electric power lockout apparatus also has a switch that is electrically coupled between the input terminal and the output terminal. The switch is capable of assuming: (1) an open state wherein the input terminal is electrically isolated from the output terminal and (2) a closed state wherein the input terminal is electrically coupled to the output terminal. The electric power lockout apparatus further has a first lock which controls operation of the switch so that the switch cannot assume the closed state unless the first lock is unlocked at least momentarily. The electric power lockout apparatus also has a locking structure to secure the electric power lockout apparatus to the power cord of an appliance.

11 Claims, 7 Drawing Sheets

ELECTRIC POWER LOCKOUT APPARATUS

TECHNICAL FIELD

The present invention relates generally to electric power switching devices and, more particularly, to an electric power lockout apparatus that provides a controlled connection between any conventional electrical device and a source of electric power so as to enable only authorized users to operate the conventional electrical device.

BACKGROUND OF THE INVENTION

Many electrical devices, such as heavy machinery or power tools (e.g., table saws, drill presses, hand tools, etc.) can be hazardous if used by untrained or inexperienced users. In a home, such devices can be particularly dangerous because they frequently attract the attention and curiosity of children who, being oblivious to the hazardous nature of such devices, may play with them and inadvertently cause serious injuries to themselves or others. In an industrial setting, use of such electrical devices may be restricted, as a matter of policy, to a small group of authorized users (e.g., those who are trained or otherwise qualified to use the electrical devices, etc.) in order to reduce the risk of serious injuries.

Other electrical devices, such as television sets, stereo equipment, and personal computers, for example, are sensitive to misuses such as repetitive actuation of power (on/oft) switches. Such misuse of a computer, for example, can cause damage to the hard disk drive thereof with the result that data stored on the hard disk drive may be corrupted or lost. This type of damage can be the result of inadvertent misuse by a child or intentional misuse by a vandal.

In addition, it may be desirable to restrict access to television sets and stereo equipment to prevent unsupervised children, for example, from watching television or listening to music or other programming altogether or simply from watching or listening at particular times without permission.

Several prior-art expedients have been developed to control the operation of electrical devices to provide limited access to such devices. One such expedient, disclosed in U.S. Pat. No. 5,434,368, issued Jul. 18, 1995, is an apparatus that includes an enclosure in which an electrical receptacle is provided for receiving a plug from an electrical appliance. The enclosure of that apparatus also houses an electrical switch which a user can use to manually control power to the electrical appliance. The enclosure is also provided with a cover that locks in place to block access to the underlying electrical switch. When a user of that apparatus wants to switch the power to the electrical appliance on or off, the user must unlock and remove the cover to expose the electrical switch and then manually toggle the switch to the desired "power on" or "power off" position. This multi-step procedure which the prior-art apparatus requires for turning the electrical appliance on and off is undesirably time-consuming and cumbersome. Moreover, installation of this prior-art apparatus may require an existing built-in electrical receptacle to be replaced which requires re-wiring and is also cumbersome. And many users of electrical devices are incapable of performing such re-wiring and may therefore be required to incur the possibly significant expense of hiring an electrician to perform the installation.

U.S. Pat. No. 5,592,032, issued Jan. 7, 1997, discloses a security electrical interrupt device that measures the amount of electrical supply current being drawn by an appliance and disconnects electric power to the appliance if an authorization code has not been entered. This device is used to limit use of certain electrical appliances, such as electric stoves, which have low-power components (e.g., a light, a timer, or a clock) and which also have high-power components (e.g., stove burners). The device enables the light, timer, and clock to be used, but the device turns off power to the appliance if a user attempts to use a burner, for example. In short, this device is useful only in connection with appliances operating at two or more different power levels and, even when used with appliances of that type, the device does not completely disconnect power therefrom. Further, this approach is not readily usable in connection with pre-existing electrical devices which are not equipped with such a device.

It is, therefore, desirable to provide an improved electrical lockout apparatus which overcomes most, if not all, of the preceding problems.

SUMMARY OF THE INVENTION

The electric power lockout apparatus of the present invention advantageously overcomes the foregoing problems encountered with prior-art power control devices and offers significant advantages over such prior-art devices. In particular, the apparatus of the present invention is quick and simple to use, requiring only the turning of a key or the entry of a code into a numeric keypad, and further is operable to completely disconnect an electrical appliance from a source of electric power, independently of any effort by a user to operate the device at any power-consumption level. The lockout apparatus of the present invention thus prevents unauthorized use of hazardous, sensitive, expensive, complicated, or other restricted-use electrical equipment, tools, devices, machinery, and appliances.

According to one aspect of the present invention, an electric power lockout apparatus includes an input terminal for electrically coupling the apparatus to an electric power source and an output terminal for electrically coupling the apparatus to a device requiring electric power. The apparatus further includes a switch electrically coupled between the input terminal and the output terminal. The switch is capable of assuming an open state wherein the input terminal is electrically isolated from the output terminal and a closed state wherein the input terminal is electrically coupled to the output terminal. A first lock controls operation of the switch, wherein the switch cannot assume the closed state unless the first lock is unlocked at least momentarily. In addition, a locking structure is provided for securing the power cord of the device requiring electric power to the electric power lockout apparatus.

The first lock preferably comprises a numeric keypad or a keyswitch. A second lock may also be provided for controlling the operation of the switch, wherein the switch cannot assume the closed state while the second lock is locked. In a preferred form, the first lock may comprise a keypad and the second lock a keyswitch. In one embodiment of the apparatus the keyswitch has first, second, and third positions, wherein while the keyswitch is in the first position, the switch assumes the closed state; while the keyswitch is in the second position, the switch assumes the open state; and while the keyswitch is in the third position, the switch cannot assume the closed state unless the first lock is unlocked at least momentarily.

Another embodiment of the apparatus has a keyswitch controlling operation of the switch, wherein the switch cannot assume the closed state when the keyswitch is open. Additionally or alternatively, the keyswitch may control operation of the switch such that the switch assumes the closed state while the keyswitch is closed.

In any embodiment, the apparatus optionally may be powered, directly or indirectly, by the electric power source, which is preferably an alternating current source, such as a 110/120 volt source, a 208 volt source, a 220/240 volt source, or a 480 volt source. Further, the switch may comprise a DC-AC relay, and the first lock may be powered by a first DC signal derived from the electric power source and may output a second DC signal which controls the DC-AC relay.

According to another aspect of the present invention, an AC electric power lockout apparatus includes a first electrical connector for connecting the apparatus to an AC electric power source, a second electrical connector for connecting a power cord of a device requiring AC electric power to the apparatus, a switching circuit capable of electrically interconnecting the first and second electrical connectors, and a locking circuit controlling the switching circuit such that the switching circuit cannot electrically interconnect the first and second electrical connectors unless the locking circuit is unlocked. A locking structure secures the power cord of the device requiring electric power to the electric power lockout apparatus.

In the above-described embodiment, the locking circuit preferably comprises either a keyswitch or a numeric keypad. Alternatively, the locking circuit may comprise first and second controlling means for controlling operation of the switching circuit, wherein the switching circuit cannot electrically interconnect the first and second electrical connectors unless the first controlling means is unlocked, and wherein the switching circuit cannot electrically interconnect the first and second electrical connectors while the second controlling means is locked. In such an embodiment, the first controlling means may comprise a keypad while the second controlling means may comprise a keyswitch.

In yet another embodiment, the apparatus may comprise a keyswitch having first, second, and third positions, wherein the first and second electrical connectors are electrically interconnected by the switching circuit while the keyswitch is in the first position, the first electrical connector is disconnected from the second electrical connector by the switching circuit while the keyswitch is in the second position, and the switching circuit cannot electrically interconnect the first and second electrical connectors unless the first connecting means is unlocked at least momentarily while the keyswitch is in the third position.

Preferably, the apparatus includes a keyswitch that controls operation of the switching circuit such that the switching circuit cannot electrically interconnect the first and second electrical connectors when the keyswitch is open. In addition, or alternatively, the keyswitch may control operation of the switching circuit such that the switching circuit electrically interconnects the first and second electrical connectors while the keyswitch is closed.

A more detailed explanation of the invention is provided in the following description and appended claims taken in conjunction with the accompanying drawings.

DETAILED DESCRIPTION OF THE PREFERRED EMBODIMENTS

Figure 1:
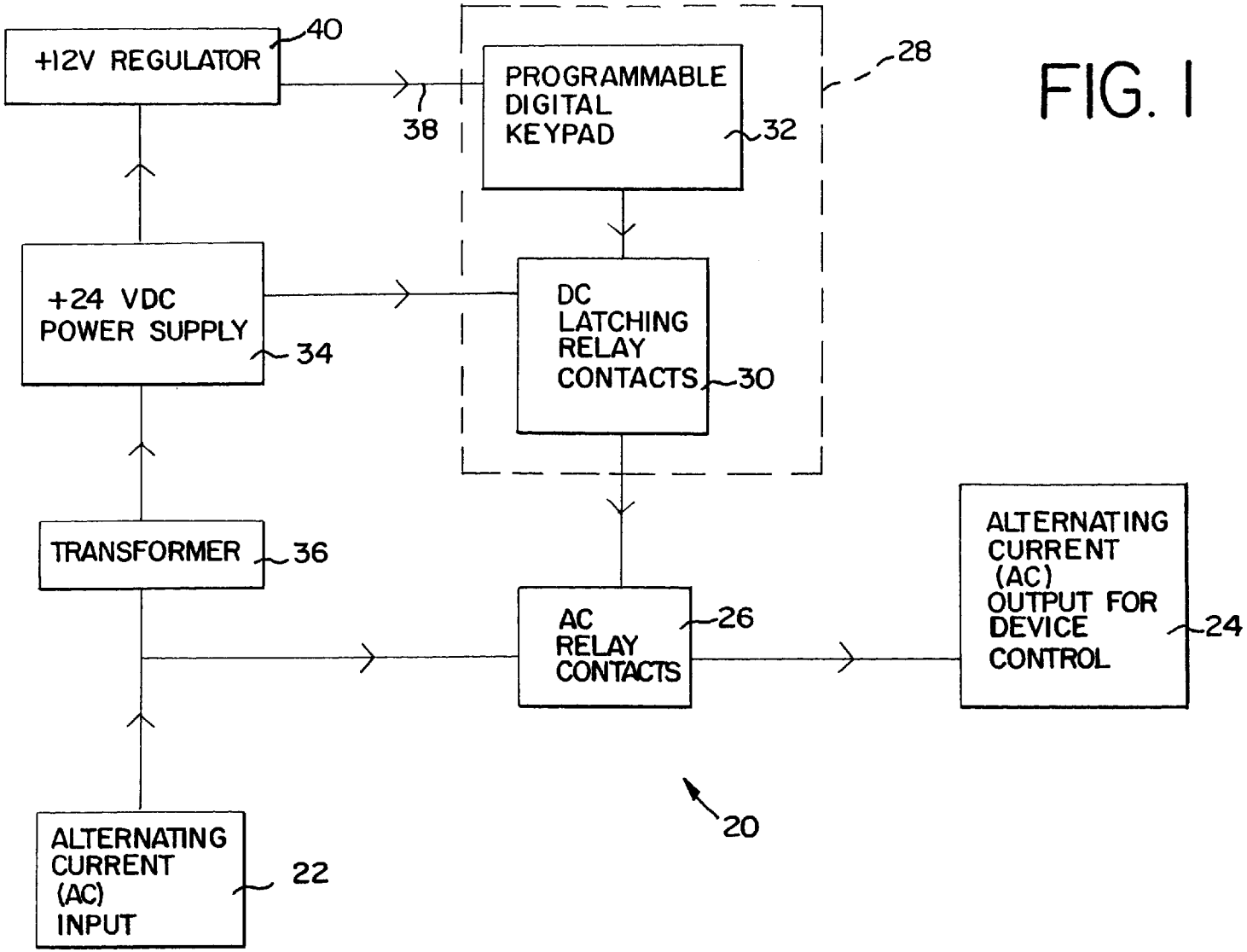
FIG. 1 is a block diagram of an electric power lockout apparatus in accordance with principles of the present invention.

FIG. 1 is a generalized block diagram of an electric power lockout apparatus 20 in accordance with the present invention. The apparatus 20 includes an alternating current (AC) input terminal 22 for electrically coupling the electric power lockout apparatus 20 to an electric power source (not shown). The electric power lockout apparatus 20 also includes an alternating-current (AC) output terminal 24 for electrically coupling the electric power lockout apparatus 20 to an appliance or other device (also not shown) that requires electric power. A switch 26 comprising, for example, one or more AC relay contacts (described in detail below in connection with FIGS. 2–4) is electrically coupled between the input terminal 22 and the output terminal 24. The switch 26 is capable of assuming an open state wherein the input terminal 22 is electrically isolated from the output terminal 24 such that a device connected to the output terminal 24 does not receive electric power from a source of electric power connected to the input terminal 22. The switch 26 is also capable of assuming a closed state wherein the input terminal 22 is electrically coupled to the output terminal 24 such that a device connected thereto does receive electric power from a power source connected to the input terminal 22.

Operation of the switch 26 is controlled by one or more locks, as described below, such that the switch 26 cannot assume the closed state unless one of the locks controlling operation of the switch 26 is unlocked at least momentarily.

In one embodiment of the present invention, operation of the switch 26 is controlled by a locking circuit 28 comprising a latching DC relay 30 (e.g., a Guardian 1395H-2C-12 V DC relay manufactured by Guardian Electric Mfg. Co. of Woodstock, Ill.) and a programmable digital keypad 32 (e.g., keypad model No. 7010 manufactured by Corby Industries, Inc., of Allentown, Pa.). Preferably, the keypad 32 is front-panel programmable simply for convenience. In addition, the keypad 32 may optionally include an internal latching circuit (e.g., keypad model No. 6020 manufactured by Corby Industries, Inc., or model No. 212I manufactured by International Electronics, Inc., of Canton, Ma.), which would obviate the need for the latching circuitry provided in the schematics of FIGS. 2 and 4. As illustrated in FIG. 1, the latching DC relay is operated by a 24-volt DC power supply 34, which may be derived, via a suitable transformer 36

(e.g., a 115 V, 50/60 Hz, 24 V @ 1 A, Stancor P-8551 transformer manufactured by Stancor of St. Louis, Mo., from the electric power supply (not shown) connected to the input terminal 22. As will be evident to those of ordinary skill in the art, the electrical parameters of the transformer 36 depend on the magnitude of the electric power supply connected to the input terminal 22 and the magnitude of the current needed to be developed by the power supply 34 to operate the latching DC relay 30. In addition, the programmable digital keypad 32 is operated by a regulated 12-volt signal 38 produced by a regulator 40 (e.g., an MC7812ACT, +12 V DC regulator manufactured by Motorola, Inc., of Tempe, Ariz.) which may, in turn, receive power from the power supply 34. Of course, the regulator 40 must be chosen to provide a voltage-regulated signal 38 at the particular voltage level required by the programmable digital key pad 32 for proper operation thereof.

The electric power supply connected to the input terminal 22 is described herein as a single-phase AC power supply. However, the invention can also be adapted for lockout of a multiple-phase AC power supply or a DC power supply. Moreover, the invention contemplates lockout of electric power at any desired magnitude. For example, the electric power supply can be a 110/120 volt AC source, a 208 volt AC source, a 220/240 volt AC source, a 480 volt AC source, or a DC source of any desired magnitude.

Figure 2:
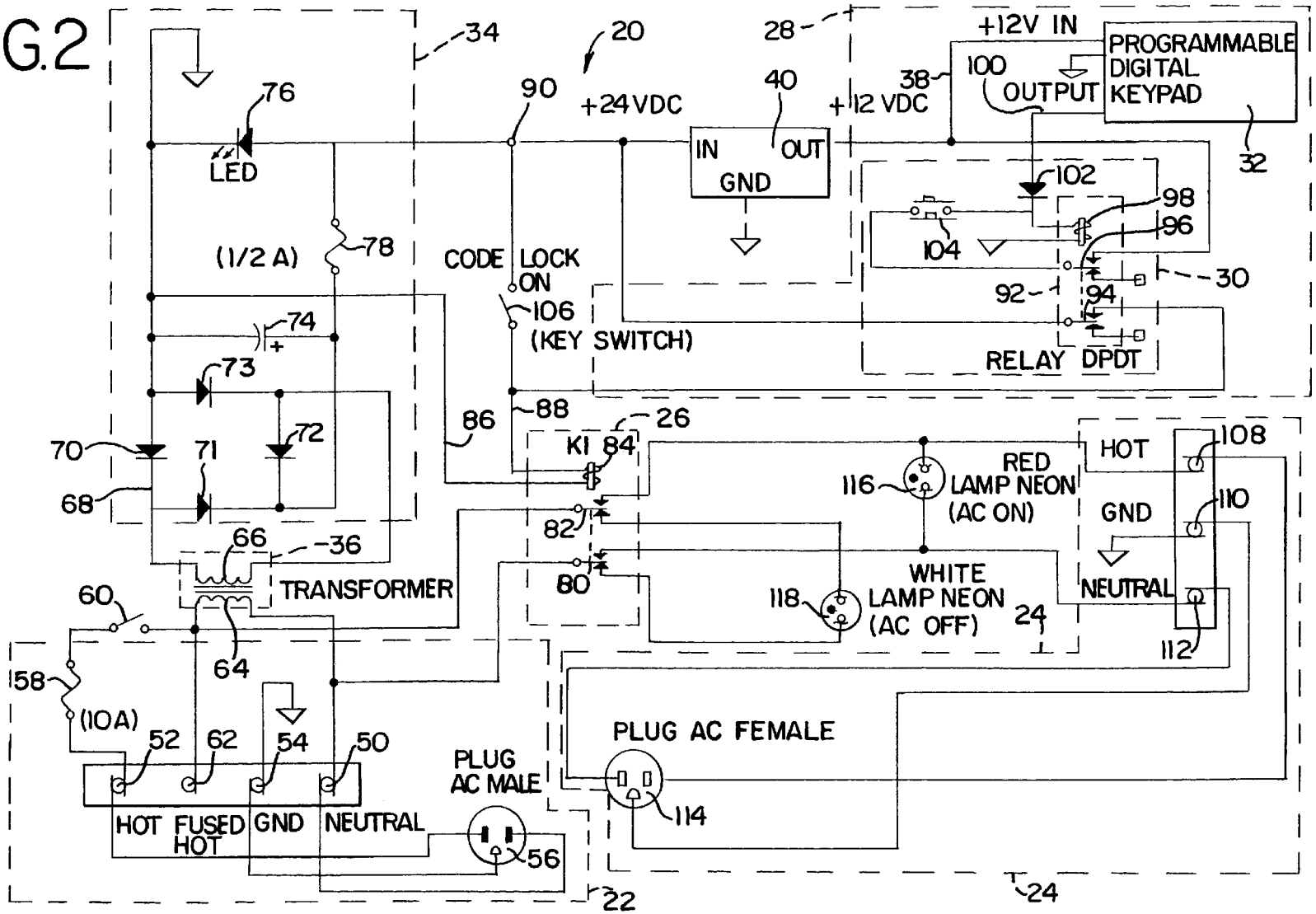
FIG. 2 is a schematic diagram illustrating one embodiment of the electric power lockout apparatus of the present invention including a keyswitch and a programmable digital keypad.

The schematic diagram of FIG. 2 illustrates the electric power lockout apparatus 20 of FIG. 1 in more detail. As shown in FIG. 2, the apparatus 20 has an input terminal 22 which includes a neutral terminal 50, an electrical "hot" terminal 52, and a ground terminal 54. The terminals 50, 52, and 54 are coupled to an electrical connector 56, such as a conventional male-end AC plug, which may be plugged into a conventional wall outlet or any other source of AC electric power. Of course, the connector 56 should be compatible with the type of electric power supply with which the apparatus 20 is to be used. The hot terminal 52 is connected through a fuse 58 and through a switch 60 to a "fused hot" terminal 62.

The switch 60 (FIG. 2) is a conventional on/off, toggle-type single-pole, single-throw (SPST) switch and is used simply to turn the electric power lockout apparatus 20 on and off. While the electric power lockout apparatus 20 does not consume an appreciable amount of electric power, it does include a number of indicator lamps, which, as described in detail below, may remain illuminated while the electric power lockout apparatus 20 is turned on, even when the appliance connected to the apparatus 20 is electrically isolated from the electric power supply. For that reason, the switch 60 is provided so that the electric power lockout apparatus 20, and all of its indicator lamps, can be turned off. Of course, the switch 60 must be electrically compatible with the voltage level of the electric power supply.

The transformer 36 (FIG. 2) has a primary winding 64 which is connected between the fused hot terminal 62 and the neutral terminal 50 to receive AC electric power from an AC electric power source connected to the electrical connector 56. The transformer 36 also has a secondary winding 66 which produces a transformed power signal, which, in turn, is rectified by a diode bridge 68 comprises diodes 70, 71, 72, 73 (e.g., No. IN4005 diodes manufactured by Multicomp of Beaverton, Oreg.). The rectified power signal developed by the diode bridge 68 is filtered by a electrolytic capacitor 74 to remove high-frequency noise therefrom. As a result, a rectified, filtered DC power signal appears at the terminals of the capacitor 74. A series combination of a light-emitting diode 76 (e.g., a green, +24 V DC LED) and a fuse 78 (e.g., the AGC ½ fast-acting fuse manufactured by Bussman, a Division of Cooper Industries of Saint Louis, Mo.) is connected in parallel with the capacitor 74 such that the light-emitting diode 76 illuminates whenever the capacitor 74 is charged by the DC power signal. The light-emitting diode 76 indicates, when illuminated, that the electric power lockout apparatus 20 is connected to a source of electric power and is turned on (via the switch 60). Of course, the light-emitting diode 76 should be selected to turn on at the voltage level to be provided at the capacitor 76.

As illustrated in FIG. 2, the switch 26 comprises a dual-pole, dual-throw (DPDT) relay (e.g., the KUHP-11DT1-24 DC-controlled relay manufactured by Potter & Brumfield, a Division of Siemens of Princeton, Ind.) comprising a pair of single-pole, double-throw (SPDT) switches 80, 82 and a relay coil 84. The relay coil 84 has first and second terminals 86, 88. As shown, the first terminal 86 is connected to the anode of the capacitor 74, which is coupled to ground. The power supply 34 delivers a rectified and filtered DC power signal to a power-supply output node 90, which is intermediate the light-emitting diode 76 and the fuse 78.

The locking apparatus 28 (described above in connection with FIG. 1) is coupled between the second terminal 88 of the relay coil 84 and the power-supply output node 90. In particular, as also illustrated in FIG. 2, the latching DC relay 30 of the locking apparatus 28 comprises a DPDT relay 92 including a pair of SPDT switches 94, 96 and a relay coil 98. The SPDT switch 94 is connected between the power-supply output node 90 and the terminal 88 of the relay coil 84 of the switch 26. Accordingly, the SPDT switch 94 is operable to electrically interconnect the power-supply output node 90 with the terminal 88 such that the relay coil 84 becomes energized to control operation of the relay switches 80 and 82 and is also operable to electrically isolate the power-supply output node 90 from the terminal 88 such that the relay coil 84 once again becomes de-energized. The operation of the switch 94 and the resultant control of the switch 26 are described in more detail below. For the purpose of that description, the SPDT switches 94, 96 are said to be "closed" when the relay coil 98 is energized and are said to be "open" when the relay coil 98 is de-energized, so that the SPDT switches 94, 96 are "normally open."

The programmable digital keypad 32, as shown in FIG. 2, has an output 100, which is coupled through a diode 102 and through the relay coil 98 to ground. When a user correctly enters the pre-programmed "unlock" code into the programmable digital keypad 32, the keypad 32 provides a short-duration signal pulse at the output 100 thereof, which energizes the relay coil 98 and closes the relay switches 94 and 96 of the relay 92. Once closed, the switch 96 permits current to flow from the output of the regulator 40, through the SPDT switch 96, through a normally closed, pushbutton switch 104, and then through the relay coil 98 to ground. As a result, the relay coil 98 remains energized, thereby latching the SPDT switches 94, 96 closed, even when the programmable digital keypad 32 ceases to provide a signal at the output 100 thereof.

The diode 102 (FIG. 2) protects the output 100 of the programmable digital keypad 32 from unwanted effects of the regulated DC signal 38 and the current flowing through the relay coil 98 once the SPDT switch 96 begins conducting current. The normally closed, pushbutton switch 104 is provided to allow a user to de-energize the relay coil 98 by momentarily pressing and opening the switch 104 so that the SPDT switches 94, 96 can become unlatched and return to the respective, normally open states thereof In other words, by pressing (opening) the normally closed pushbutton switch 104, a user can cut off power to the device connected output terminal 24.

It will be apparent, then, to those of ordinary skill in the art, that the locking apparatus 28 of FIG. 2 serves to control operation of the relay switches 80, 82, by establishing an electrical connection between the power-supply output node 90 and the relay coil 84 whenever the pre-programmed code is correctly entered into the programmable digital keypad 32. This electrical connection may alternatively be established by closing a keyswitch 106, which is coupled directly between the power-supply output node 90 and the terminal 88 of the relay coil 84 (i.e., in parallel with the keypad locking circuit 28). In either case, when the electrical connection is established, the relay 84 becomes energized and the SPDT switches 80, 82 are closed (i.e., moved to the upper positions thereof as shown in FIG. 2). This, in turn, electrically couples the input terminal 22 to the output terminal 24.

The output terminal 24 of FIG. 2 includes an electrical "hot" terminal 108, a ground terminal 110, and a neutral terminal 112. The terminals 108, 110, and 112 are coupled to an electrical connector 114, such as a conventional female-end AC plug, into which the male-end AC power cord of any conventional electrical appliance may be inserted. When the switch 82 is closed, the output hot terminal 108 is electrically coupled to the input fused-hot terminal 62. Similarly, when the switch 80 is closed, the output neutral terminal 112 is electrically coupled to the input neutral terminal 50. Conversely, when the relay coil 84 is de-energized, the SPDT switches 80 and 82 open and the output hot and neutral terminals 108, 112 become electrically isolated from the input fused-hot and neutral terminals 62, 50, respectively. At all times, the input ground terminal 54 and the output ground terminal 110 are connected to a common ground.

An indicator lamp 116 (FIG. 2), such as a red Leecraft 1030D1 neon indicator manufactured by Leecraft of Dearfield Beach, Fla., is connected across the output hot and neutral terminals 108 and 112 and illuminates when the switches 80 and 82 are closed to indicate that electric power is being supplied to the outlet terminal 24. A second indicator lamp 118, such as a white Leecraft 1030D4 neon indicator manufactured by Leecraft of Deerfield Beach, Fla., is connected across the otherwise unused second throw contacts of the switches 80, 82 and thus illuminates when the switches 80, 82 are open to indicate that electric power is not being supplied to the outlet terminal 24.

Figure 3:
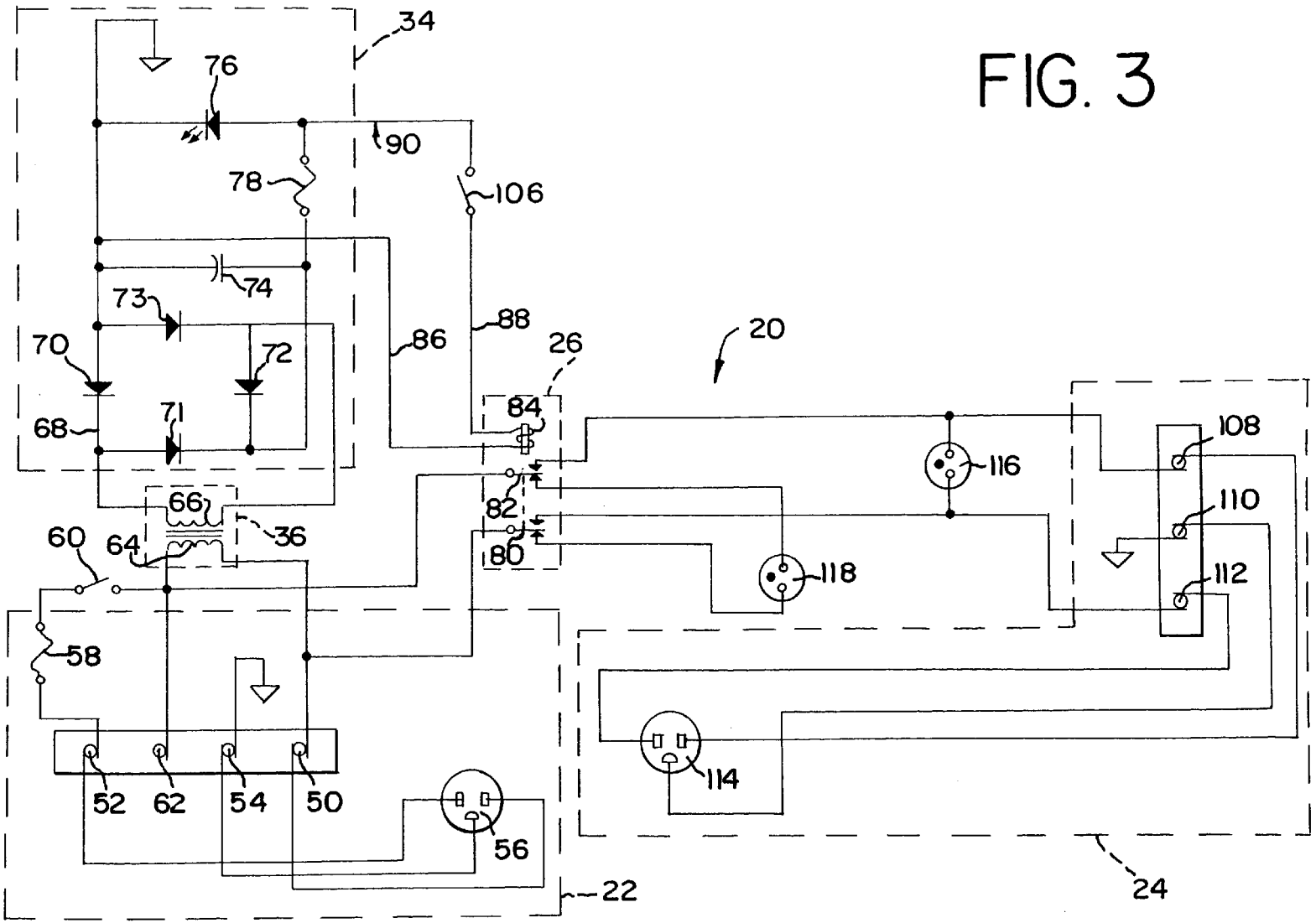
FIG. 3 is a schematic diagram similar to FIG. 2 but including only a keyswitch.

The schematic of FIG. 3 depicts an embodiment similar to that of FIG. 2, but the programmable digital keypad 32 of FIG. 2 and all associated circuitry is omitted in the embodiment of FIG. 3, and only the SPST keyswitch 106 is provided in the latter embodiment for connecting the terminal 88 of the relay coil 84 with the power-supply output node 90. Thus, when the SPST keyswitch 106 is closed, the relay coil 84 is energized, causing the SPDT switches 80, 82 to close and electrically connect the input terminal 22 to the output terminal 24. Conversely, when the SPST keyswitch 106 is opened, the relay coil 84 becomes de-energized, the switches 80, 82 open, and the output terminal 24 is disconnected or electrically isolated from the input terminal 22. As this embodiment requires fewer components than the embodiment of FIG. 2, it is correspondingly less expensive to manufacture.

Figure 4:
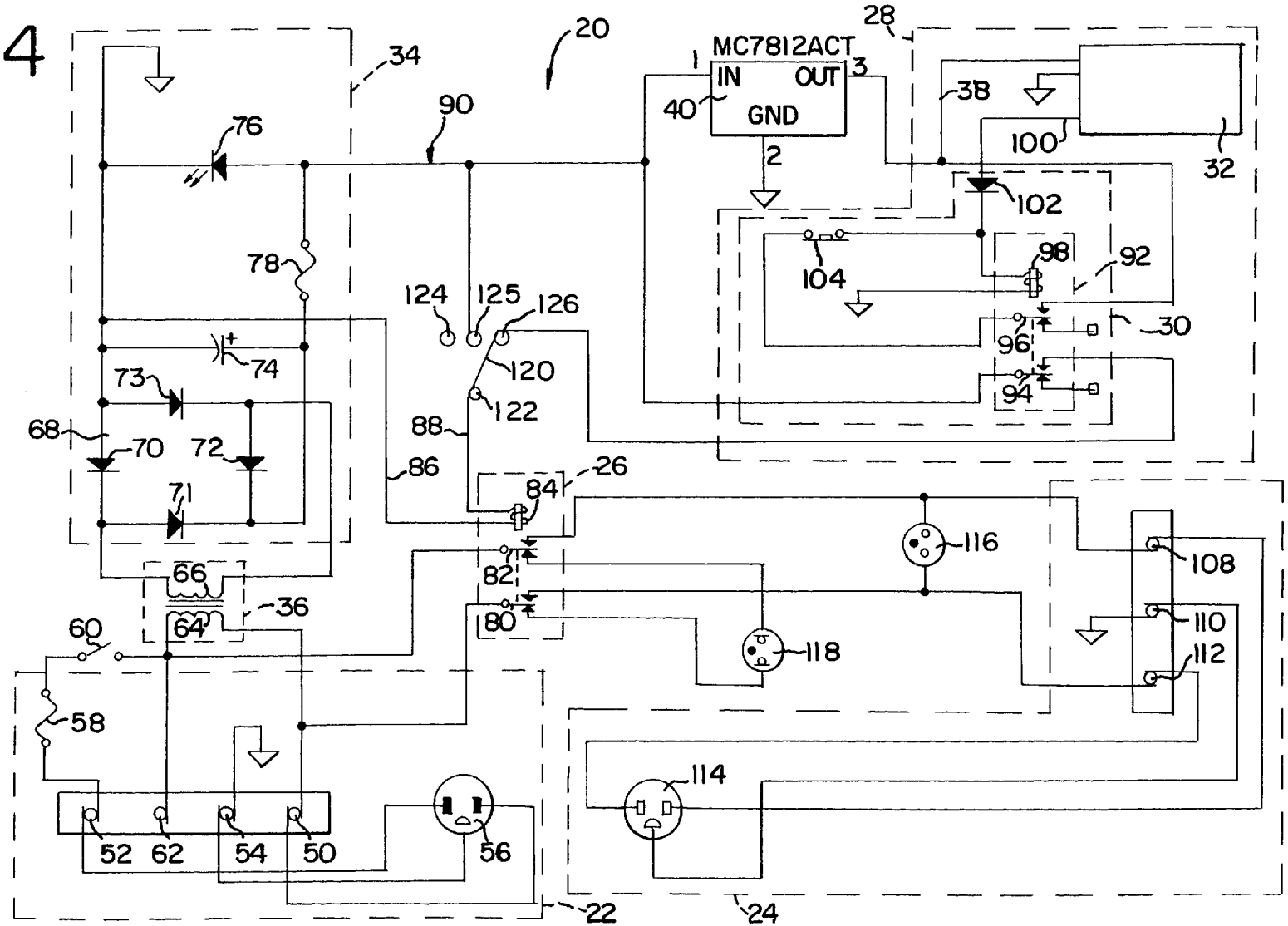
FIG. 4 is a schematic diagram of another embodiment of the electric power lockout apparatus of the present invention.

FIG. 4 depicts another embodiment similar to FIG. 2 wherein the keyswitch 106 of FIGS. 2–3 is replaced by a three-position or single-pole, triple-throw (SPTT) keyswitch 120 (e.g., SPTT keylock switch Model No. S1343 manufactured by Oslo Switch, Inc. of Cheshire, Conn.). The SPTT keyswitch 120 has a single pole 122 and three throws or contacts 124, 125, and 126. The contact 124 is unconnected, the contact 125 is electrically coupled to the power-supply output node 90, and the contact 126 is electrically coupled to the upper throw contact of the SPDT switch 94 of the latching DC relay 92. The three positions of this keyswitch 120 are designated "LOCK OFF," which corresponds to the pole 122 being electrically coupled to the unconnected contact 124; "LOCK ON," which corresponds to the pole 122 being electrically coupled to the contact 125; and "CODE," which corresponds to the pole 122 being electrically coupled to the contact 126.

When the SPTT keyswitch 120 of FIG. 4 is in the LOCK OFF position, the terminal 88 of the relay coil 84 is electrically isolated from the power-supply output node 90, such that the relay coil 84 is de-energized, the switches 80, 82 are open, and the input terminal 22 is electrically isolated from the output terminal 24. When the SPTT keyswitch 120 is in the LOCK ON position, the terminal 88 is coupled to the power-supply output node 90 such that the relay coil 84 is energized, the switches 80, 82 are closed, and the input terminal 22 is electrically coupled to the output terminal 24. When the SPTT keyswitch 120 is in the CODE position, the relay coil 84 is energized, thereby electrically interconnecting the input and output terminals 22 and 24, respectively, only when the pre-programmed code is entered into the programmable digital keypad 32, such that the functional lock implemented by the locking circuit 28 is unlocked at least momentarily.

Figure 5:
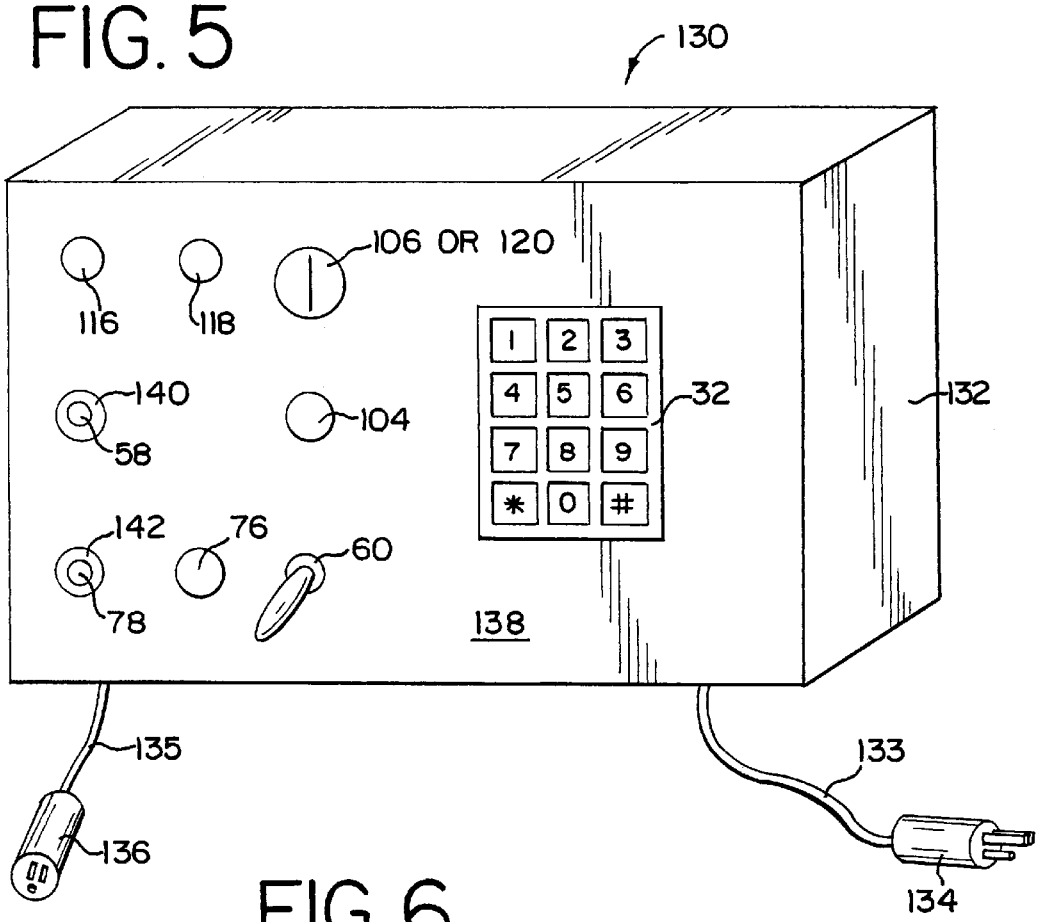
FIG. 5 is a perspective of an electric power lockout apparatus in accordance with principles of the present invention.

FIG. 5 depicts an electric power lockout apparatus 130 comprising a housing 132 containing circuitry such as that illustrated in one of FIGS. 2–4 in accordance with the present invention. Extending outside of the housing 132 are a first electrical conductor 133 having a male-end connector 134 (corresponding to the connector 56 of FIGS. 2–4) for connecting the apparatus 130 to an electric power source (not shown) and a second electrical conductor 135 (corresponding to the connector 114 of FIGS. 2–4) having a female-end connector 136 for connecting an electrical device or appliance (not shown) to the electric power lockout apparatus 130. The various controls and indicators for the apparatus described above in connection with FIGS. 2–4 can be mounted on a front surface 138 of the housing 132. The controls include the on/off switch 60, the keyswitch 106 or 120, the reset pushbutton 104, and the programmable digital keypad 32. The indicators include the power-on LED 76, the red "AC ON" lamp 116, and the white "AC OFF" lamp 118. In addition, receptacles 140 and 142 can be provided on the front surface 138 of the housing 132 for receiving the fuses 58 and 78, respectively.

It should be readily apparent that the electric power lockout apparatus 130 of the present invention can only lockout electric power from an electrical device if the apparatus 130 remains electrically interposed between the electric power supply and the electrical device. If, for example, an unauthorized user could disconnect the power cord of an electrical device from the apparatus 130 and plug it into a wall outlet or other electric power supply, the apparatus 130 would effectively be bypassed and incapable of preventing unauthorized use of, or tampering with, the electrical device. For that reason, the electric power lockout apparatus 130 is provided with some suitable locking structure for securing the power cord of the electrical device to the electrical connector 136 of the apparatus 130.

Figure 6:
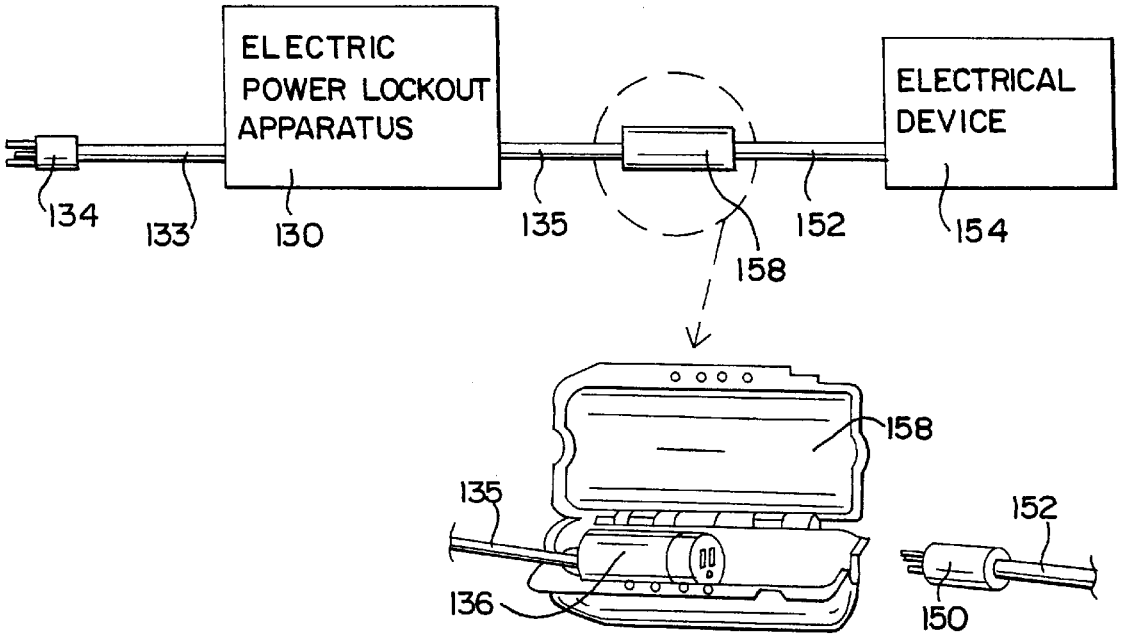
FIG. 6 is a perspective of a plugout closure device, shown in an open position, for securing a power cord to the power lockout apparatus of the present invention.

FIG. 6 illustrates one such locking structure comprising a plugout closure device and lockable casing 158 for securing a male-end electrical connector 150 of a power cord 152 of an electrical device 154 to the electrical connector 136 of the electric power lockout apparatus 130. As shown therein, the male-end electrical connector 134, which is coupled to the apparatus 130 by the conventional electrical conductor 133, can be plugged into a wall outlet or connected to any other desired electric power supply (not shown), and the female-end electrical connector 136, into which the male-end electrical connector 150 of the electrical device 154 may be plugged, is disposed within the plugout closure device and lockable casing 158. Examples of the plugout closure device and lockable casing are the Hubbell Plugout model 65695 (for small electrical connectors 136, 150) or 65968 (for large electrical connectors 136, 150) and the Brady Plug Lockout model 65674 (for a 110 V device) or 65675 (for a 208 to 550 V device) manufactured by Brady-Signmark Division of Milwaukee, Wis. In use, the casing 158 of the plugout closure device is closed and locked to secure the connection of the connector 150 to the connector 136 and thereby prevent the electric power lockout apparatus 130 from being bypassed.

Figure 7:
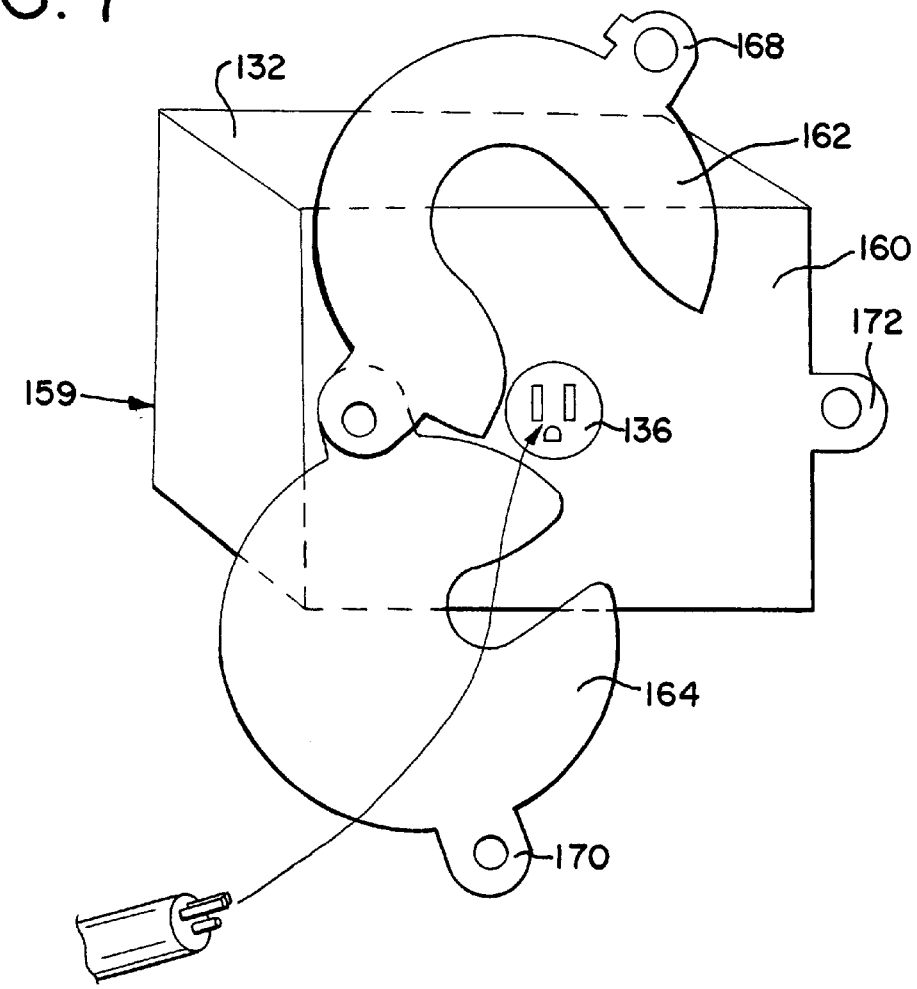
FIG. 7 is a perspective of an alternative structure, shown in an open position, for securing power cord to the power lockout apparatus of the present invention.
Figure 8:
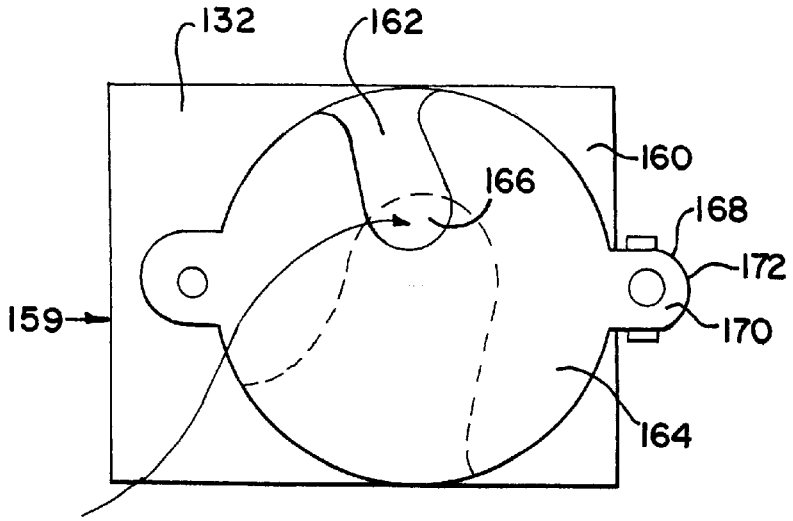
FIG. 8 is a front view of the structure of FIG. 7, shown in a closed position.
Figure 9:
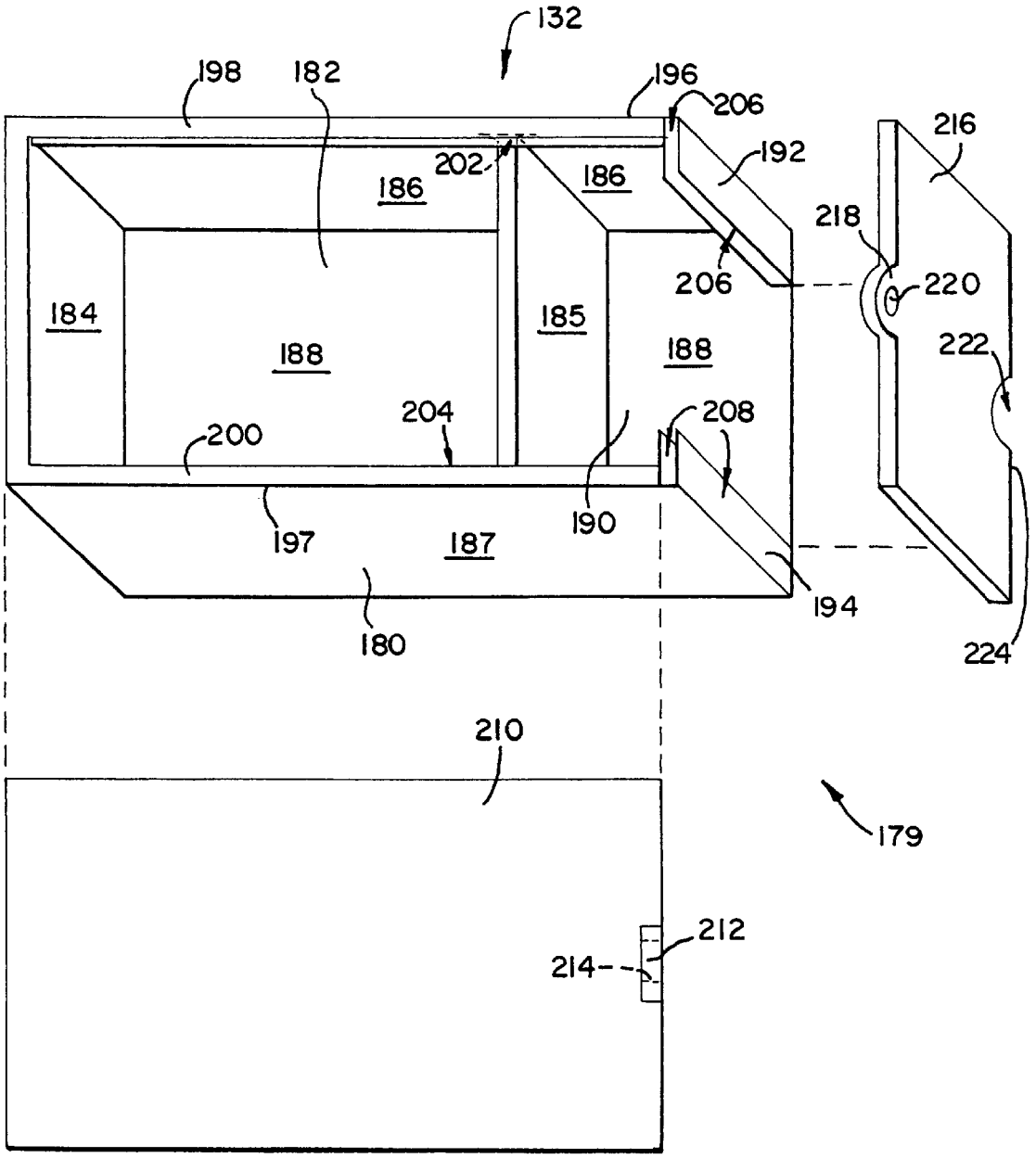
FIG. 9 is an exploded, assembly view of another alternative embodiment of structure for securing a power cord to the power lockout apparatus of the present invention.

In some circumstances, it may be desirable to use other types of locking structures for securing the electrical connector 150 of the electrical device or appliance 154 to the electrical connector 136 of the electric power lockout apparatus 130. Two such alternative structures are depicted in FIGS. 7–9. Each of these structures represents a modification of the housing 132 of the electric power lockout apparatus 130 shown in FIG. 5.

The locking structure 159 of FIGS. 7 and 8 comprises a chamber 160 defined by a housing 132. The female-end electrical connector 136 is mounted within the chamber 160, and the electrical connector of an electrical device, when plugged into the connector 136 is fully disposed within the chamber 160. First and second substantially complementary cover portions 162, 164 are pivotably mounted to the housing 132 and can therefore pivot between a first, open position shown in FIG. 7, wherein the chamber 160 is accessible so that an appliance may be plugged into or disconnected from the electrical connector 136, and a second, closed and locked position shown in FIG. 8, wherein the chamber 160 is substantially covered by the first and second cover portions 162 and 164.

As shown in FIGS. 7 and 8, the first and second cover portions 162 and 164 are shaped to substantially cover the chamber 160 when in the second position thereof, except that an opening 166, defined by the first and second cover portions 162 and 164 when in the second position thereof, remains uncovered. This opening 166 must be large enough to accommodate the power cord 152 (FIG. 6) of the electrical device 154 (FIG. 6) to be connected to the electric power lockout apparatus 130 (FIG. 6), but small enough to prevent the electrical connector 150 (FIG. 6) on that power cord 152 (FIG. 6) from being disconnected from the connector 136 and removed from the chamber 160. The first and second cover portions 162, 164 have respective locking tabs 168 and 170, which are aligned with a matching locking tab 172 on the housing 132 when the cover portions 162 and 164 are in the second position thereof. A padlock (not shown) may thus be used to secure the cover portions 162, 164 in the second position thereof to thereby retain the electrical connector 150 (FIG. 6) of the appliance 154 (FIG. 6) within the chamber 160 to prevent unwanted bypassing of the electric power lockout apparatus 130 (FIG. 6).

An alternative locking structure 179 is illustrated in FIG. 9. In this embodiment, the housing 132 has a main portion 180 comprising a first chamber 182, defined by walls 184–187 and a bottom 188, and a second chamber 190 adjacent the first chamber 182 and defined by the walls 185–187, the bottom 188, and wall portions 192 and 194. The circuitry of an electric power lockout apparatus according to the present invention is disposed in the first chamber 182, and the female-end electrical connector 136 (FIG. 5) is disposed in the second chamber 190 of FIG. 9. The chamber 190 must be large enough to fully enclose the male-end electrical connector 150 of an appliance 154 (such as that illustrated in FIG. 6) as well as the female-end electrical connector 136. Provided along an upper edge 196, 197 of each of the walls 186 and 187 is a respective flange 198 and 200 defining a corresponding groove 202 or 204. Further, each wall portion 192 and 194 has a respective groove 206 or 208 that extends along an edge thereof which is perpendicular to the base 188. The housing 132 also includes a first cover 210 which may be slidably inserted into the grooves 202 and 204 to help enclose and further define the first and second chambers 182 and 190. A tab 212 having a hole 214 therein for receiving any conventional padlock is provided on the first cover 210. The housing 132 further includes a second cover 216, which may be slidably inserted into the grooves 206, 208 to enclose and further define the second chamber 190. The second cover 216 has a tab 218 disposed for alignment with the tab 212 of the first cover 210 and has a hole 220 therein so that the first and second covers 210 and 216 can be locked together by a conventional padlock or combination lock (not shown) inserted through the holes 214 and 220. A semi-circular notch 222 is provided along an edge 224 of the second cover 216. The notch 222 must be large enough to accommodate the power cord 152 of an electrical device 154, which extends through the notch 222 when the housing 132 is fully assembled, but small enough to prevent the electrical connector 150 (FIG. 6), which is then plugged into the connector 136 within the second chamber 190, from being removed from the second chamber 190 of the fully assembled housing 132

Among the many advantageous attributes of the electric power lockout apparatus of this invention are:

1. Outstanding performance;
2. Easy, user-friendly operation;
3. Reliability;
4. Safety;
5. Low cost;
6. Efficiency; and
7. Effectiveness in locking out electric power from conventional electrical devices to be protected without the need to make any modifications to such conventional electrical devices or the electrical receptacles to which such devices are connected.

The foregoing description is for the purpose of teaching those skilled in the art the best mode of carrying out the invention and is to be constructed as illustrative only. Numerous modifications and alternative embodiments of the invention will be apparent to those skilled in the art in view of this description, and the details of the disclosed structure may be varied substantially without departing from the spirit of the invention. Accordingly, the exclusive use of all modifications with the scope of the appended claims is reserved.

What is claimed is:

1. An electric power lockout apparatus, comprising:

an input terminal for electrically coupling the apparatus to a device requiring electric power;

a switch electrically coupled between the input terminal and the output terminal and capable of assuming an open state wherein the input terminal is electrically isolated from the output terminal and a closed state wherein the input terminal is electrically coupled to the output terminal;

a first lock controlling operation of the switch, wherein the switch cannot assume the closed state unless the first lock is unlocked at least momentarily;

a locking structure for securing the power cord of the device requiring electric power to the electric power lockout apparatus; and a keyswitch having first, second, and third positions, wherein the switch assumes the closed state while the keyswitch is in the first position, the switch assumes the open state while the keyswitch is in the second position, and the switch cannot assume the closed state unless the first lock is unlocked at least momentarily while the keyswitch is in the third position.

2. The apparatus of claim 1, wherein the first lock comprises a keypad.

3. The apparatus of claim 1, further comprising a second lock controlling operation of the switch, wherein the switch cannot assume the closed state while the second lock is locked.

4. The apparatus of claim 1, wherein the apparatus is powered by the electric power source.

5. The apparatus of claim 1, wherein the electric power source is an alternating current source.

6. The apparatus of claim 1, wherein the electric power source comprises a voltage source selected from the group consisting of a 110/120 volt source, a 208 volt source, a 220/240 volt source, and a 480 volt source.

7. The apparatus of claim 1, wherein the switch comprises a DC-AC relay.

8. The apparatus of claim 7, wherein the first lock comprises a DC powered lock powered by a first DC signal derived from the electric power source, and said DC powered lock outputs a second DC signal which controls the switch comprising the DC-AC relay.

9. An electric power lockout apparatus, comprising:

a first electrical connector for connecting the apparatus to an electric power source;

a second electrical connector for connecting a power cord of a device requiring electric power to the apparatus;

a switching circuit capable a electrically interconnecting the first and second electrical connectors;

a locking circuit controlling the switching circuit such that the switching circuit cannot electrically interconnect the first and second electrical connectors unless the locking circuit is unlocked;

a locking structure for securing the power cord of the device requiring electric power to the electric power lockout apparatus;

a keyswitch having first, second, and third positions, wherein the first and second electrical connectors are electrically interconnected by the switching circuit while the keyswitch is in the first position, the first electrical connector is disconnected from the second electrical connector by the switching circuit while the keyswitch is in the second position, and the switching circuit cannot electrically interconnect the first and second electrical connectors unless the locking circuit is unlocked at least momentarily while the keyswitch is in the third position.

10. The apparatus of claim 9, wherein the locking circuit comprises a keypad.

11. The apparatus of claim 9, wherein the apparatus is powered by an electric power source comprising an alternating current source selected from the group consisting of a 110/120 volt source, a 208 volt source, a 220/240 volt source, and a 480 volt source.

* * * * *